United States Patent [19]

Singleton, Jr.

[11] Patent Number: 4,986,429

[45] Date of Patent: Jan. 22, 1991

[54] COLOR INDICATING TAMPER-PROOF SEAL

[76] Inventor: Robert Singleton, Jr., 1134 East Broadway, South Bend, Ind. 46618

[21] Appl. No.: 364,660

[22] Filed: Jun. 12, 1989

[51] Int. Cl.[5] ..... B65D 51/18

[52] U.S. Cl. ..... 215/230; 206/459; 206/807; 428/321.5; 428/916

[58] Field of Search ..... 215/230, 365, 203, 246, 215/254; 206/807, 459; 428/321.5, 916

[56] References Cited

U.S. PATENT DOCUMENTS

| | | | |
|---|---|---|---|
| 3,896,965 | 7/1975 | Cornell . | |
| 4,424,911 | 1/1984 | Resnick . | |
| 4,429,803 | 2/1984 | Butterfield | 215/230 X |
| 4,480,760 | 11/1984 | Schonberger | 215/230 |
| 4,511,052 | 4/1985 | Klein et al. . | |
| 4,516,679 | 5/1985 | Simpson et al. . | |
| 4,526,752 | 7/1985 | Perlman et al. . | |
| 4,685,578 | 8/1987 | Dunshee | 215/230 |
| 4,685,579 | 8/1987 | Stapleton . | |
| 4,755,405 | 7/1988 | Massucco et al. | 206/459 X |
| 4,760,919 | 8/1988 | Pereyra | 206/807 X |

FOREIGN PATENT DOCUMENTS

| | | | |
|---|---|---|---|
| 16613 | 12/1971 | Australia | 215/246 |
| 2459050 | 7/1975 | Fed. Rep. of Germany | 206/459 |

*Primary Examiner*—Stephen Marcus

*Attorney, Agent, or Firm*—Beaman & Beaman

[57] ABSTRACT

A tamper-proof seal employed with a container comprising a plurality of frangible cells filled with a harmless colored substance. The cells may either be located between two hermetically sealed plastic sheets or formed on the exterior of the seal and upon puncturing or applying pressure necessary for entry into the container the cells rupture releasing the substance to provide a visual indication that tampering with the container may have occurred.

12 Claims, 1 Drawing Sheet

COLOR INDICATING TAMPER-PROOF SEAL

BACKGROUND OF THE INVENTION

Many food and drug substances destined for human consumption are distributed within containers Unfortunately, situations have occurred where the contents of the container have been adulterated by unauthorized entry into the container without indication to the consumer that the container has been entered. Often, this tampering leads to death or serious harm to the consumer and in order to reduce the risk of a consumer ingesting an adulterated dosage means have been developed for indicating if tampering has occurred.

A typical example of a tamper-proof seal incorporated with a container includes surrounding the container with a cellophane or clear plastic wrapping However, the plastic might be completely removed and subsequently replaced with no knowledge thereof being conveyed to the consumer.

Other attempts of containers incorporating tamper-proof means include affixing pliable material containing chemical substances to portions of the container where pressure must be applied for entry. The material may change color from either absorbing chemicals released by pressure applied to the container during opening, or from ambient atmosphere conditions exposed to the material during opening. Typical examples of such tamper-proof seals are shown in U.S. Pat. No. 4,424,911 and 4,511,052. Another container incorporating tamper-proof means is shown in U.S. Pat. No. 4,516,679 which includes a wrap for encasing a container whereby visual indication of a tampering by a wrap discoloration, physical change, or deterioration alerts the user that the product within the wrap may have been adulterated.

Tamper-proofing means of the aforementioned type undergo color change through chemical reactions requiring chemical substances that in addition to adding to the manufacturing cost of the product may unknowingly come in contact with the contents of the container, thus making the tamper-proof seal itself a health risk to the consumer.

It is an object of the invention to provide a reliable tamper-proof seal to be employed with drug or food filled containers by which to warn of possible unauthorized tampering with the container or contents thereof.

Another object of the invention is to provide a reliable tamper-proof seal to be employed with a drug or food filled container wherein the seal itself is manufacturable at low cost and is free of substances that might be harmful to the consumer.

Yet another object of the invention is to provide a reliable tamper-proof seal to be employed with a drug or food filled container that includes a plurality of cells filled with a harmless visible substance, whereby the substance is released from cells during entry, or attempted entry into the container.

A further object of the invention is to provide a reliable tamper-proof seal that includes a plurality of substance filled cells, wherein the cells are soluble in hot water such that upon submerging the seal in hot water the substance is released Another object of the invention is to provide a reliable tamper-proof seal that would provide a visual indication of possible tampering from pressure applied to the seal or from a puncture therethrough even if such puncture is as small as that would be made by a hypodermic needle.

In the practice of the invention the tamper-proof seal is employed with a container and comprises a strip of plastic material having a plurality of frangible cells filled with a substance such as food coloring or dye formed thereon In one version of the invention the seal is located on a portion of the container where force must be applied for entry which breaks the cells releasing the substance to provide visual indication of possible tampering. The seal is provided with releasable means for authorized removal of the seal permitting entry into the container without rupturing the cells. In another embodiment the cells are located between two sheets of plastic, at least one being transparent, hermetically sealed around the outer edges providing a vacuum therebetween. The seal is affixed over the container opening sealing off the container and a cap or lid may be placed over the seal. Upon puncture or pressure being applied to the seal for entry into the container, even by an object as small as a hypodermic needle, the cells rupture releasing the dye between the sheets, whereby the released dye is readily visible detected through the transparent sheet for visually indicating that the container may have been adulterated. In both embodiments, the dye or substance contained in the cells is harmless to the consumer and upon the cells rupturing the substance is merely released to provide visual means to the consumer that the container may have been tampered.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
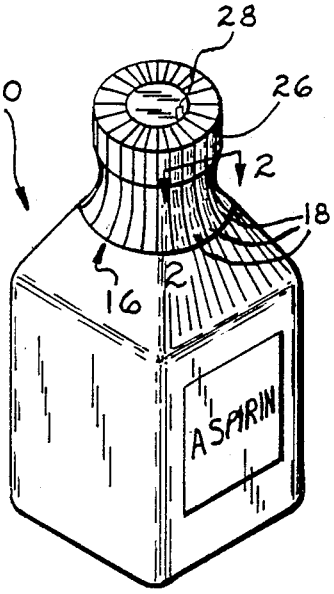
FIG. 1 is a perspective view of a container incorporating a tamer-proof seal in accord with the invention.
Figure 2:
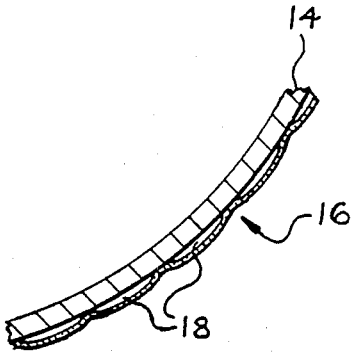
FIG. 2 is a plan, enlarged, detail, sectional view, taken along Section II—II of FIG. 1.
Figure 3:
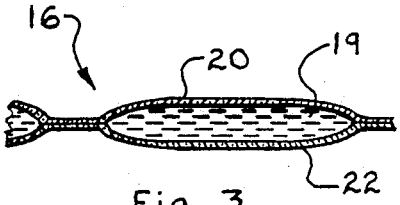
FIG. 3 is an enlarged, detail, sectional view of a cell of the tamper-proof seal of FIG. 2.
Figure 4:
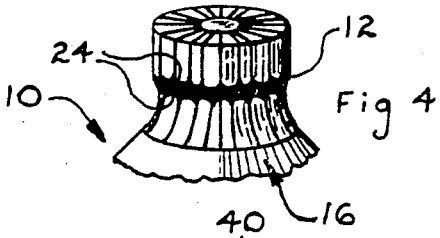
FIG. 4 is a perspective view of a container incorporating the tamper-proof seal in accord with the invention, showing the seal after being ruptured and releasing a visible substance.

In FIGS. 1–4 a container or bottle 10 is shown utilizing a tamper-proof seal in accord with a first preferred embodiment of the present invention. The bottle 10 has a threaded neck 12 on which a threaded cap 14 is received to close the bottle in a conventional manner.

The seal, generally indicated at 16, comprises a shroud or envelope of flexible material having a plurality of integrally formed frangible elongated cells 18. The cells 18 extend the height of the envelope, are adjacent each other and are formed by sheets 20 and 22 hermetically sealed by heat or other bonding to form the cells 18 which contain a harmless liquid substance generally indicated at 19. Preferably, the sheets are formed of a water soluble material, but may be of vinyl or other plastic type material, and the liquid may be mineral oil or other non-aqueous solution.

The seal 16 is tightly fitted around the neck 12 which is of a smaller diameter than the cap 14 and pressure must be applied to remove the cap 14 for entry into the bottle 10. Upon exerting the necessary rotative force on the cap 14 for removal thereof, the cap 14 will rotate while the lower portion of the envelope affixed to the neck 12 will be stationary and the cells 18 will rupture releasing the liquid substance 19 to the exterior of the bottle 10 as indicated at 24 in FIG. 4. The substance 19 will also be released if the seal 16 is stretched or submerged in hot water since the cell walls 20 and 22 are water soluble and will dissolve. As a result of the substance 19 being released tampering with the bottle 10 is readily visible detected by potential consumers of the contents of the bottle.

The seal 16 is preferably provided with a pull strip 26 having a tab 28 to facilitate removal of the seal 16 from the cap 14 and neck 12 without rupturing the cells 18 for providing authorized entry to the bottle 10. The seal 16 may be removed by the consumer simply by pulling downward on the tab 28 which rips the strip 26 through the seal envelope at a cell-free location A notice on the bottle 10, not shown, may serve as a warning to the consumer not to use the contents of the bottle if the seal is missing or if the dye has been released.

In assembling the seal 16 to the bottle 10 and cap 14 the seal may first be attached to the neck 12 and then the cap placed upon the neck. The cells 18 can then be filled with substance 19, such as food coloring and then the upper end of the seal is heat sealed over the top of the cap.

Figure 6:
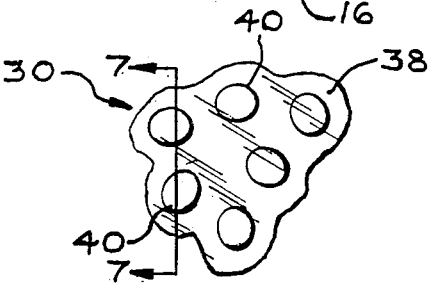
FIG. 6 is an enlarged, greatly magnified partial view of the tamper-proof seal shown in FIG. 5.
Figure 7:
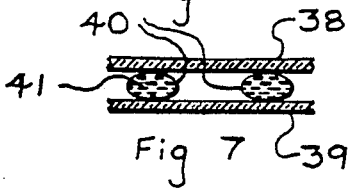
FIG. 7 is an elevational, detail, enlarged, sectional view, 24 taken along Section VII—VII of FIG. 6.
Figure 8:
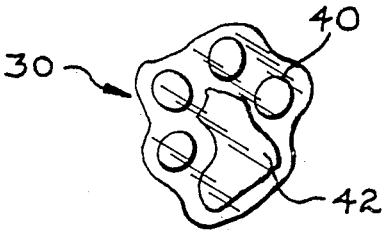
FIG. 8 is a view similar to FIG. 6, showing one of the cells being ruptured releasing a visible substance.
Figure 5:
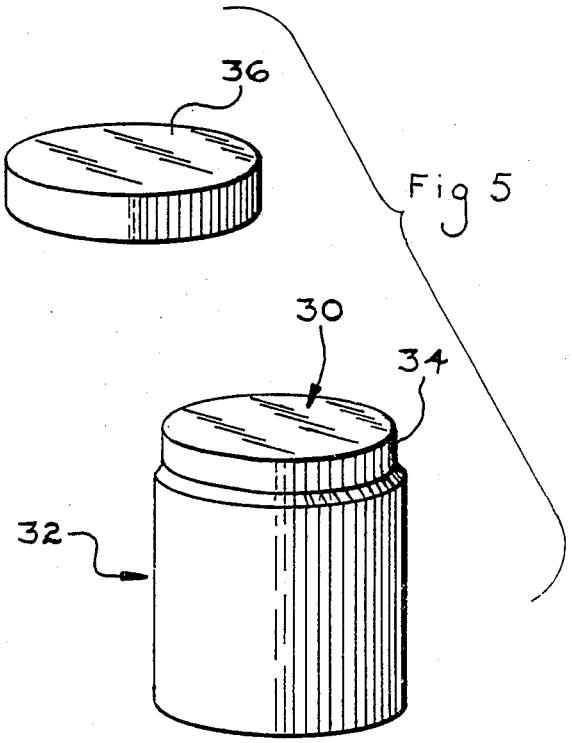
FIG. 5 is a perspective exploded view of a jar utilizing another embodiment of a tamper-proof seal in accord with the invention.

In FIGS. 5–8 a tamper-proof seal generally indicated at 30 is shown in accord with a second embodiment of the invention. The seal 30 is employed with a wide opening container or jar 32, FIG. 5, having a threaded neck 34 adjacent an open end. The outer edge of the seal 30 is bonded to the neck 34 sealing off the opening of the jar 32. The jar 32 is also provided with a threaded lid 36 that is receivable on the neck 34 over the seal 30.

The seal 30 comprises two sheets of plastic material, an upper layer 38 and a lower layer 39, hermetically sealed around the outer edges and the air between the layers is removed providing a vacuum therein. A plurality of frangible, thin walled cells 40 are located between the sheets 38 and 39 and contain a bright colored liquid substance generally indicated at 41. Preferably, the substance may be a harmless liquid such as food coloring, but may be a fine powdered substance. Once pressure is applied to the seal 30 to remove the seal from the jar 32, the exerted pressure would be enough to rupture some of the cells 40 releasing the substance 41 between the sheets 38 and 39 forming a visible mark, as shown at 42 in FIG. 8, readily visible detected by potential consumers of the contents of the jar 32 to warn of possible tampering. Also, if the seal 30 was punctured, even by something as small as a hypodermic needle, it would break the vacuum causing the cells 40 to rupture and release the substance 41 in the same manner as previously described.

It is appreciated that various modifications to the inventive concepts may be apparent to those skilled in the art without departing from the spirit and scope of the invention.

I claim:

1. A tamper-proof seal for sealing a container comprising, in combination, a hermetically sealed frangible envelope, a chamber defined within said envelope, a transparent portion defined in said envelope, a sub-atmospheric pressure within said envelope, indicating means within said chamber having a first visible condition at said sub-atmospheric pressure and a second visible condition at a pressure greater than said sub-atmospheric pressure visibly discernibly different than said first condition whereby fracture of said envelope may be visibly ascertained.

2. A tamper-proof seal wrap for sealing the opening of a container comprising, in combination, two sheets of thin film material hermetically sealed around their outer edges providing a vacuum therein, at least one of said sheets being transparent, a sub-atmospheric pressure existing between said sheets, at least one frangible, thin walled cell located between said vacuum sealed sheets sensitive to pressure exerted thereon and adapted to fracture under pressure changes such as due to removal of said seal wrap from the container, release of the sub-atmospheric pressure between said sheets and puncturing, said cell being filled with a color indicating substance such that upon puncture or pressure being applied to said seal for entry into the container said cell will rupture releasing said indicating substance between said sheets whereby said released substance is readily visible detectable through said transparent sheet.

3. In a pamper-proof seal wrap as in claim 2, said indicating substance being food coloring.

4. In a tamper-proof seal wrap as in claim 2, said indicating substance being ink.

5. In a tamper-proof seal wrap as in claim 2, said indicating substance being dye.

6. A tamper-proof seal employed with a container having a neck and a cap receivable thereon comprising, in combination, a sheet of plastic material tightly affixed to the cap and neck of the container, said sheet of material including a plurality of elongated individual frangible cells, each of said cells extending between the cap and neck and fixed with respect to the cap and to the neck and each filled with a colored visible indicating substance such that when the cap is removed from the neck of the container said cells rupture releasing said indicating substance.

7. In a tamper-proof seal as in claim 6, said sheet of material being soluble in water and said indicating substance being non-aqueous whereby upon submerging said seal in water said cells dissolve releasing said substance.

8. In a tamper-proof seal as in claim 6, said seal including releasable means permitting said seal to be removed from the container without rupturing said cells.

9. In a tamper-proof seal as in claim 8, said releasable means comprising a tear strip.

10. In a tamper-proof seal as in claim 6, said colored indicating substance being food coloring.

11. In a tamper-proof seal as in claim 6, said colored indicating substance being ink.

12. In a tamper-proof seal as in claim 6, said color indicating substance being dye.

* * * * *